US007334860B2

(12) United States Patent
Mitsunaga et al.

(10) Patent No.: US 7,334,860 B2
(45) Date of Patent: Feb. 26, 2008

(54) IMAGE FORMING RANGE VARYING SYSTEM OF IMAGE FORMING APPARATUS AND METHOD OF VARYING IMAGE FORMING RANGE

(75) Inventors: Osamu Mitsunaga, Hino (JP); Masaaki Shibuya, Hino (JP)

(73) Assignee: Olympus Corporation, Tokyo (JP)

( * ) Notice: Subject to any disclaimer, the term of this patent is extended or adjusted under 35 U.S.C. 154(b) by 280 days.

(21) Appl. No.: 11/018,234

(22) Filed: Dec. 20, 2004

(65) Prior Publication Data

US 2005/0140704 A1 Jun. 30, 2005

(30) Foreign Application Priority Data

Dec. 25, 2003 (JP) ..... 2003-431487

(51) Int. Cl.
*B41J 29/393* (2006.01)

(52) U.S. Cl. ..... 347/19; 347/13; 347/42

(58) Field of Classification Search ..... 347/5, 347/12, 13, 19, 42, 9; 400/279
See application file for complete search history.

(56) References Cited

U.S. PATENT DOCUMENTS 6,305,856 B1 * 10/2001 Miyazaki ..... 400/279
6,386,668 B1 * 5/2002 Shimizu et al. ..... 347/13

FOREIGN PATENT DOCUMENTS

JP 2001-096874 A 4/2001

* cited by examiner

*Primary Examiner*—Lam Son Nguyen
(74) *Attorney, Agent, or Firm*—Frishauf, Holtz, Goodman & Chick, P.C.

(57) ABSTRACT

The present invention discloses an image forming range varying system of an image forming apparatus, and an image forming range varying method, the system is mounted on the image forming apparatus comprising at least two head rows in which ink heads arranged as predetermined overlap in end portions, in a scanning direction of the ink head with respect to a conveying direction of an image forming medium, and an image of the conveyed image forming medium is detected by an image sensor, both ends shapes of the conveyed image forming medium are detected, and an address of an ink nozzle is set/driven in accordance with the shape of an image to be formed to thereby form the image.

26 Claims, 5 Drawing Sheets

| Ink nozzle address | Selection of head row 0 : row A, 1: row B | Nozzle jet timing 0 : $X_{A1}$, 1: $X_{B1}$ | White data process 0 : OFF, 1 : ON | Joining process 0 : OFF, 1 : ON |
|---|---|---|---|---|
| h1~h10 | 0 | 0 | 1 | 0 |
| h11 | 0<br>1 | 0<br>1 | 1 | 0 |
| h12~h20 | 1 | 1 | 1 | 0 |
| h21 | 0<br>1 | 0<br>1 | 1 | 0 |
| h22~h26 | 0 | 0 | 1 | 0 |
| h27~h30 | 0 | 0 | 0 | 0 |
| h31 | 0<br>1 | 0<br>1 | 0 | 1 |
| h32~h40 | 1 | 1 | 0 | 0 |
| h41 | 0<br>1 | 0<br>1 | 0 | 1 |
| h42~h50 | 0 | 0 | 0 | 0 |
| h51 | 0<br>1 | 0<br>1 | 0 | 1 |
| h52~h54 | 1 | 1 | 0 | 0 |
| h55~h61 | 1 | 1 | 1 | 0 |
| ⋮ | ⋮ | ⋮ | ⋮ | ⋮ |
| Ink nozzle address | Selection of head row 0 : row A, 1: row B | Nozzle jet timing 0 : $X_{An}$, 1 : $X_{Bn}$ | White data process 0 : OFF, 1 : ON | Joining process 0 : OFF, 1 : ON |
| h1~h7 | 0 | 0 | 1 | 0 |
| | | | | |

FIG. 6

| Ink nozzle address | Selection of head row [0,0] : A row, [1,0] : A'row [0,1] : B row, [1,1] : B'row | Nozzle jet timing [0,0] : $X_{A1}$, [1,0] : $X'_{A1}$ [0,1] : $X_{B1}$, [1,1] : $X'_{B1}$ | White data process 0 : OFF , 1: ON | Joining process 0 : OFF , 1: ON |
|---|---|---|---|---|
| | | | | |

FIG. 7

IMAGE FORMING RANGE VARYING SYSTEM OF IMAGE FORMING APPARATUS AND METHOD OF VARYING IMAGE FORMING RANGE

CROSS-REFERENCE TO RELATED APPLICATIONS

This application is based upon and claims the benefit of priority from prior Japanese Patent Application No. 2003-431487, filed Dec. 25, 2003, the entire contents of which are incorporated herein by reference.

BACKGROUND OF THE INVENTION

1. Field of the Invention

The present invention relates to an image forming apparatus which forms an image on an image forming medium, particularly to an image forming range varying system and a method of varying an image forming range in which an image is formed in accordance with a shape of the conveyed image forming medium.

2. Description of the Related Art

In general, in an image forming apparatus represented by a printer or a copying machine, an image forming medium (hereinafter referred to as the medium) is conveyed, and an image is formed during the conveyance. For example, in the image forming apparatus of an ink jet system, ink is jetted to a medium (e.g., printer sheet) conveyed to a conveying unit such as a platen from a head nozzle of an ink head, and the image is formed. At this time, when a shape of the medium (forming range) does not agree with that of the formed image (forming range), the ink is jetted to the conveying system to convey the medium in a portion in which the shapes do not agree with each other, and this is a cause for dirt.

Therefore, the medium passes a predetermined position in a medium supply system and a medium conveying system at a predetermined timing, and the medium is obliquely inclined with respect to a conveying direction (X-axis direction or sub-scanning direction), and hereof, have to be prevent being so obliquely inclined of the medium. For example, in Jpn. Pat. Appln. KOKAI Publication No. 2001-96874, a technique has been described in which a detection unit to detect an end portion in image receiving paper P is disposed, a recording head to form the image is controlled in response to a detection signal (presence region information) of the detection unit, and the jetting of the ink is stopped in a portion where the image receiving paper P does not exist to prevent dirt on the periphery.

As described above, the protruding image ink sticks to the conveying unit including the platen, and the back surface of the medium to be treated next is made dirty. Then, according to a configuration shown in the Jpn. Pat. Appln. KOKAI Publication No. 2001-96874, an image recording apparatus is described having an ink head in which a light source for detection, formed in a range longer than a transverse width of image receiving paper P, a plurality of light receiving elements to receive reflected light from the image receiving paper P by the light source for the detection, and a plurality of ink nozzles are integrally formed in order from an upstream side of the conveying direction in the conveying direction (sub-scanning direction) of the image receiving paper P (medium).

The image recording apparatus has such a constitution that the ink is not jetted from the ink nozzle which has not detected the image receiving paper P by detection signals (presence region information in the end portion of the image receiving paper P) of the plurality of light receiving elements. Prior to the ink-jet timing, a delay time t is determined from the speed at which the image receiving paper P is conveyed and the distance between the ink nozzle and the point on the paper P, at which the light beam emitted from the detecting light source is applied to the paper P. The application of ink from the nozzle is delayed by the time t thus determined. Note that the distance is one measured in the sub-scanning direction.

BRIEF SUMMARY OF THE INVENTION

According to the present invention, there are provided an image forming range varying system of an image forming apparatus and an image forming range varying system, in which an end portion shape and a positional shift in a sub-scanning direction of a conveyed medium are detected and in which an image is formed on a medium in accordance with the end portion of the medium.

According to the present invention, there is provided an image forming range varying system for an image forming apparatus mounted on the image forming apparatus which jets an ink liquid to a conveyed image forming medium to form an image the system, comprising: an ink head unit comprising at least two head rows in which at least a plurality of ink heads are alternately arranged with a predetermined overlap in a substantially vertical direction with respect to a conveying direction along the conveying direction of the image forming medium; a first detection unit which is disposed on a supply, side of the image forming medium and which detects a tip portion of the image forming medium; a conveying mechanism which conveys the image forming medium and which sends conveying information of the image forming medium; a second detection unit which detects both transversal side ends of the image forming medium; an image forming range production unit which produces/outputs information of an image forming range with respect to the image forming medium based on information of the second detection unit; and a control unit which varies/controls an image forming operation based on pre-stored appropriate image forming timing information and the information of the image forming range production unit.

Moreover, according to the present invention, there is provided an image forming range varying method of an image forming apparatus, comprising: a first step of detecting a tip portion of a conveyed image forming medium on a supply side of the image forming medium; a second step of detecting both transversal side ends of the image forming medium conveyed, based on a moving distance detection signal in a conveying mechanism using a detection signal of the tip portion of the image forming medium as a trigger; a third step of producing information of an image forming range with respect to the image forming medium based on position data of the both transversal side ends of the image forming medium; a fourth step of setting image forming conditions onto the image forming medium to a control unit based on pre-stored appropriate image forming timing data of the image forming medium and information of an image forming range production unit; and a fifth step of driving each ink head constituting at least two head rows to thereby form the image of image data of the image forming apparatus based on the image forming conditions setup to the control unit.

BRIEF DESCRIPTION OF THE SEVERAL VIEWS OF THE DRAWING

FIG. 6 is a diagram showing one example of a setting table inside a forming control section 2 which executes each ink nozzle control in each ink head; and FIG. 7 is a diagram showing one example of the setting table set inside the forming control section 2.

DETAILED DESCRIPTION OF THE INVENTION

Embodiments of the present invention will be described hereinafter in detail with reference to the drawings.

Figure 1:
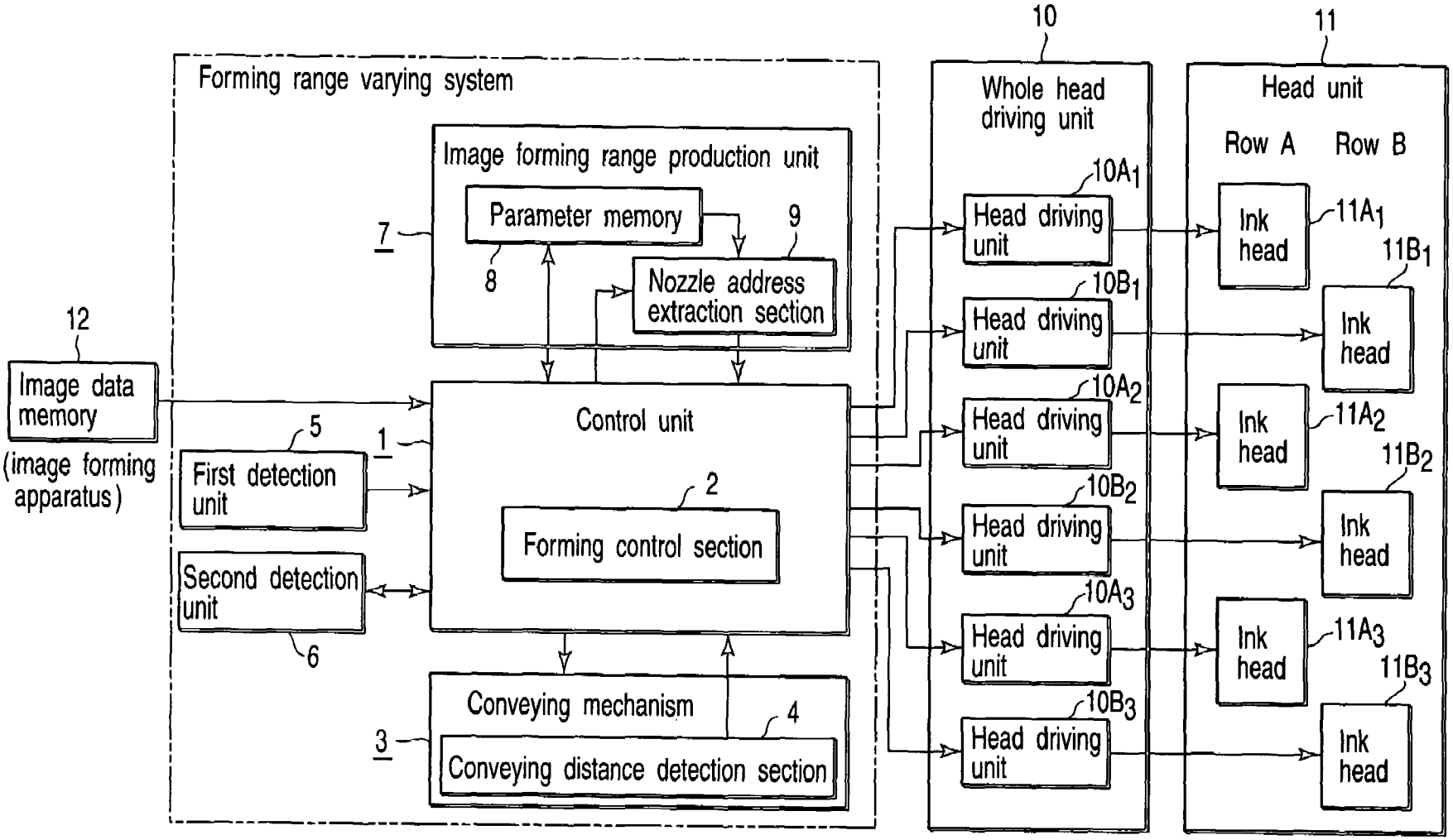
FIG. 1 is a diagram showing a conceptual constitution example of an image forming apparatus on which an image forming range varying system according to a first embodiment of the present invention is mounted.

FIG. 1 shows a conceptual constitution example of an image forming apparatus on which an image forming range varying system according to a first embodiment of the present invention is mounted. It is to be noted that in the following embodiments and modifications, a conveying direction of an image forming medium (hereinafter referred to as a medium) is defined as an X-axis direction or a sub-scanning direction, and a direction crossing the conveying direction at right angles is defined as a Y-axis direction or a main scanning direction.

The present embodiment comprises: a control unit 1 disposed in an image forming apparatus to control a whole system, and having a forming control section 2 which varies/controls an image forming range with respect to a medium; a conveying mechanism 3 conveying the medium supplied from a medium supply system, and having a conveying distance detection section 4 which outputs medium conveying information; a first detection unit 5 disposed on a downstream side of the medium supply system to detect a tip portion of the medium supplied to the conveying mechanism 3; a second detection unit 6 which is disposed between the first detection unit 5 and the conveying mechanism 3 and which detects both transversal side ends (transverse width) of the medium; and an image forming range production unit 7 having a nozzle address extraction section 9 which extracts a nozzle address for use in forming an image for each ink head based on information detected by the second detection unit 6, and a parameter memory 8 described later.

The conveying mechanism 3 comprises a so-called platen mechanism. The conveying distance detection section 4 comprises, for example, an encoder and the like, and outputs information (moving amount of a platen belt) of a medium conveying amount. The first detection unit 5 comprises, for example, an optical transmission or reflection type sensor, an electrostatic capacity type sensor or the like. The second detection unit 6 comprises, for example, a line sensor, an image sensor or the like.

Moreover, the image forming apparatus is provided with a head unit 11 and a head driving unit 10. In the head unit 11, six ink heads comprising a plurality of nozzles for forming the image are divided into two rows: a row A (11A1 to 11A3) and a row B (11B1 to 11B3). The head driving unit 10 (10A1 to 10A3, 10B1 to 10B3) drives the ink heads of the rows A and B.

In the present embodiment, for the sake of convenience in description, the head unit by six ink heads has been described as an example, but the present invention is not limited to this example. One color of image can be formed by one set of head units. When a color image is formed, at least four or more sets of head units are required.

Furthermore, the image forming range production unit 7 extracts the shape of the medium, that is, a non-image-forming position from both transversal side ends (transverse width) obtained by the image sensor 6. Thereafter, an address of a nozzle which does not jet any ink liquid is extracted with respect to the ink head, and an image forming range on the medium is defined by the nozzle address extraction section 9. Moreover, an ink liquid reference jet timing is read from the parameter memory 8 with respect to the ink head rows A and B in the ink head unit 11, and variable information of the image forming range is output to the control unit 1. It is to be noted that manufacturing errors (finished dimension errors, etc.) of constituting elements or assembly errors of the constituting elements generated in manufacturing the apparatus are stored in the parameter memory 8. The assembly errors are each ink liquid reference jet timing information (encoder pulse number of the conveying distance detection section 4 using the signal of the first detection unit 5 as a trigger) of the ink head rows A and B at a preset medium conveying time with respect to machine differences with each apparatus.

The forming control section 2 in the control unit 1 controls the image forming range in such a manner as to vary (see FIG. 3B) the range with respect to the head driving unit 10 (10A1 to 10A3, 10B1 to 10B3) by the ink nozzle address, and the ink jet timing with respect to the medium in the ink head rows A and B. The ink nozzle address defines the image forming range (any ink liquid is no jet in a range in which there is not any medium) assigned to the ink head rows A and B, which is the variable information of the image forming range.

Figure 2:
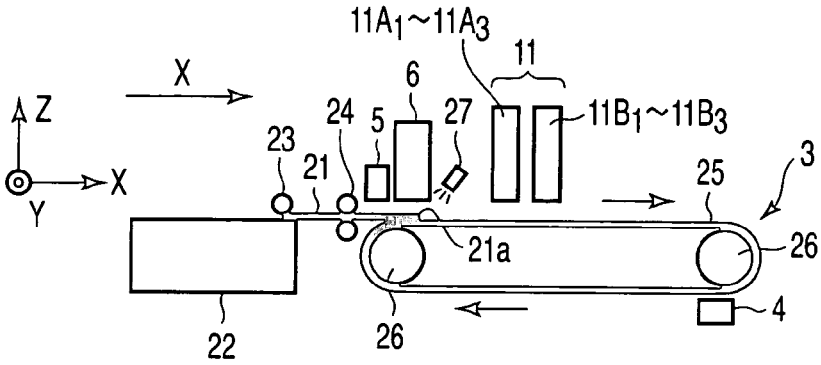
FIG. 2 is a diagram showing an arrangement example of constituting elements constituting a conveying system of a medium and an image forming range varying system in a first embodiment.

FIG. 2 is a diagram showing an arrangement example of constituting elements constituting the conveying mechanism 3 of the medium and the image forming range varying system.

This example comprises: a supply cassette 22 which contains a plurality of mediums 21; a supply roller 23 which successively takes out the mediums 21 one by one from the supply cassette 22; a registration roller pair 24 which corrects the medium 21 with respect to a sub-scanning direction; an edge sensor 5 which detects a tip portion 21*a* of the medium 21 immediately after passage of the registration roller pair 24; an image sensor 6 which is the second detection unit disposed between the edge sensor 5 and the head unit 11 to detect both transversal side ends (width) 21*b* of the medium 21 in the main scanning direction; an illumination unit 27 which illuminates a part under the image sensor 6; a platen belt 25 which conveys the medium under the respective ink heads (11A1 to 11A3, 11B1 to 11B3); and two platen rollers 26 around which the platen belt 25 is extended and rotated to convey the medium 21. It is to be noted that such as a suction pump (not shown) is mounted in a platen mechanism of the conveying mechanism 3, and has a function of adsorbing the medium 21 laid on the platen belt 25 onto the platen belt 25. This adsorption prevents the medium 21 positioned on the platen belt 25 from being moved or shifted from the belt.

In this constitution, an optical transmission type sensor is used in the edge sensor 5 which is the first detection unit, and the sensor detects light interruption by the medium 21. The image sensor 6 which is the second detection unit performs so-called edge detection by a difference of contrast between the medium 21 and the platen belt 25. Therefore, the platen belt 25 preferably has a color which easily makes a difference of contrast from the color of the medium 21. For example, when the medium 21 is white, the platen belt 25 is set in such a manner as to have a dark color such as black. The registration roller pair 24 abuts on the tip portion of the medium, and is bent. Thereafter, the pair rotates and coveys the medium, so that tilt of the tip portion is eliminated.

Next, a flow of image formation by image data in this image forming apparatus will be described with reference to FIGS. 1 and 2.

First, a sheet of medium 21 is taken out of the supply cassette 22 by the supply roller 23. Next, after correcting skewing with respect to the main scanning direction by the registration roller pair 24, the edge 21*a* of the medium 21 is detected by the edge sensor 5. A detection signal (trigger signal) of the edge sensor 5 is received by the control unit 1, and thereafter the control unit 1 lights the illumination unit 27 in such a manner as to brings the image sensor 6 into a standby state, and prepares for acquisition of data of the both transversal side ends 21*b*. In this constitution, unnecessary lighting of the illumination unit 27 is prevented, and life of the illumination unit 27 is lengthened.

The medium 21 is transferred to the platen belt 25, and starts passing under the image sensor 6. At this time, the control unit 1 starts acquiring data from the image sensor 6. The control unit 1 transmits the data (main scanning direction width of the medium 21, so-called width data) to the nozzle address extraction section 9. The nozzle address extraction section 9 reads reference ink liquid jet timing in the ink head row A (11A1 to 11A3) and the ink head row B (11B1 to 11B3) from the parameter memory 8. The data representing the jet timing is transmitted to the control unit 1. The data is information of a variable image-forming range and is supplied from the control unit 1 to the forming control section 2.

At this time, the image stored in an image data memory 12 of the image forming apparatus is read to the forming control section 2 by the control unit 1. In the image formation of this image data, a process to jet no ink liquid (referred to as a white data process) is performed with respect to each nozzle address of the ink head rows A and B based on the image forming range variable information by the forming control section 2.

Next, the forming control section 2 controls the formation (image forming) by the respective ink nozzles of the ink head rows A and B at each ink liquid reference jet timing based on the information of the nozzle address to which the white data process has been assigned.

As described above, in the forming control section 2, the respective head driving units 10A1 to 10A3, 10B1 to 10B3 drive the ink head row A (11A1 to 11A3) and the ink head row B (11B1 to 11B3) to thereby realize the image formation in which the image forming range on the medium 21 has been varied.

Next, the image formation after varying the image forming range in the image forming range varying system mounted on the image forming apparatus constituted in this manner will be described with reference to FIGS. 1 to 3A to 3C, and 6.

Figure 3A:
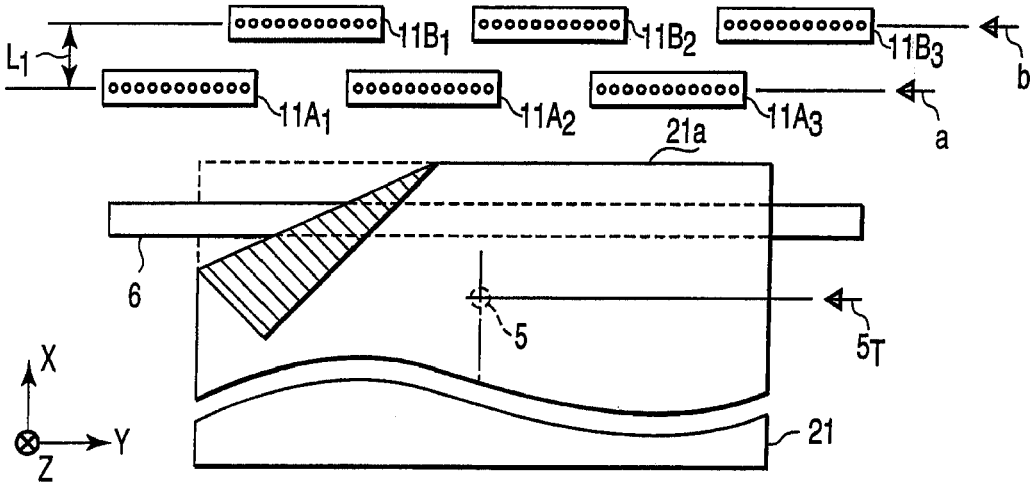
FIGS. 3A, 3B, 3C are diagrams showing an arrangement positions of ink head and the medium, and an ink nozzle address process state in the first embodiment.

FIG. 3A is a diagram of the conveying mechanism 3 of the image forming apparatus viewed upwards (Z-direction) from the conveying surface. This figure shows an arrangement relation of the first detection unit 5, the second detection unit 6, the respective ink heads (11A1 to 11A3, 10B1 to 10B3), and the medium 21 arranged in order from the upstream side of the conveying direction of the medium.

Figure 3B:
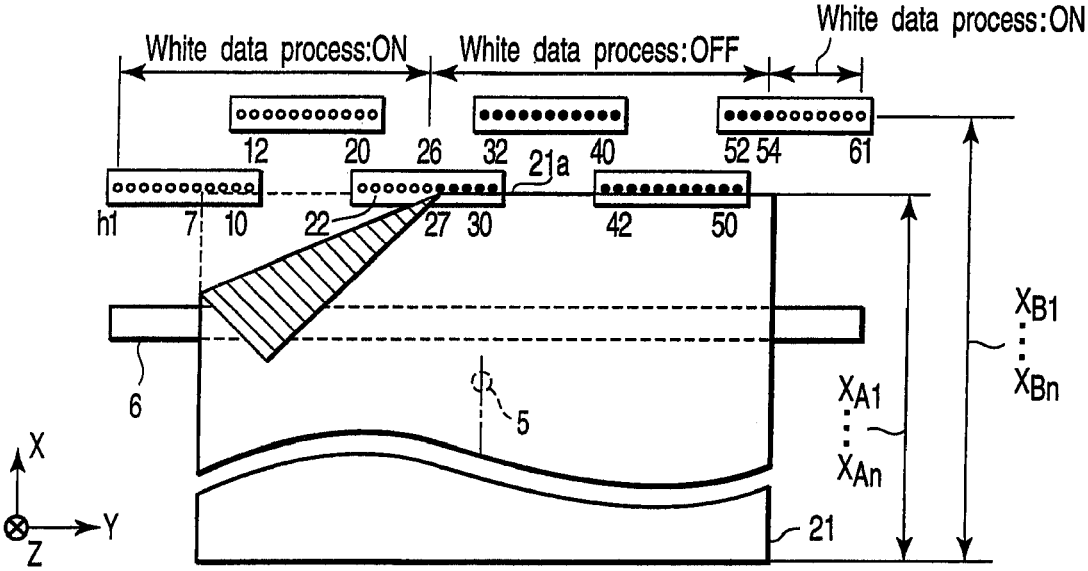

FIG. 3B is an explanatory view of each ink nozzle control for varying the image forming range with respect to the medium 21 in each ink head. FIG. 6 shows a setting table inside the forming control section 2 which executes each ink nozzle control in each ink head in FIG. 3B.

As to the respective ink heads, two head row A (11A1 to 11A3) and head row B (11B1 to 11B3) constitute the head unit 11. These head rows A and B are arranged alternately (predetermined distance L1) with respect to the conveying direction (sub-scanning direction) of the medium 21 with a predetermined overlap in the end portion in the main scanning direction of the ink heads.

In FIG. 3A, a and b indicate ink liquid reference jet timings (a: head row A, b: head row B) stored beforehand in the parameter memory 8 based on the machine difference for each image forming apparatus. The timings a and b are determined by a signal (pulse number) of the conveying distance detection section 4 (encoder) sent to the control unit 1, when the medium 21 is further conveyed on the downstream side after a trigger signal 5T at the time of edge detection of the tip portion of the medium 21 by the first detection unit 5.

Moreover, when the trigger signal 5T is sent to the control unit 1, the control unit 1 drives the second detection unit 6 (image sensor) to bring the unit into a standby state, and lights the illumination unit 27 shown in FIG. 2.

When the medium 21 is conveyed under the second detection unit, the second detection unit 6 continuously detects the both transversal side ends of the medium 21 in synchronization with the signal of the conveying distance detection section 4 to thereby recognize the shape of the medium 21.

Next, a procedure of an image forming range varying process of the present invention will be described with reference to FIG. 3B.

In this first embodiment, a case where one of the tip portions is bent downwards (slant line portion) and conveyed because of some problem after the medium 21 passes through the first detection unit 5 is assumed. It is also assumed that the image forming range on the medium 21 based on the image data 12 falls on the whole surface of the medium 21. The respective ink nozzles in two head rows A and B, less than actual nozzles, are shown for the sake of description, and ink nozzle addresses are shown with sequential numbers from the left side of the figure.

Moreover, two head rows A and B form one line of image formation in the main scanning direction on the medium 21 based on the image data 12. The ink liquid jet timings of forming lines in these head rows A and B are shown by the head row A (XA1 to XAn) and head row B (XB1 to XBn) for each head row. That is, when the both transversal side ends of the medium 21 are continuously detected by the second detection unit 6, the ink nozzle address with respect to the image formation onto the medium 21 is extracted for each ink liquid jet timing of each forming line by the nozzle address extraction section 9 in the image forming range production unit 7.

When the image is formed on the medium 21 such shown in FIG. 3B, the respective ink nozzle addresses (h1 to h26) and (h55 to h61) are set in such a manner that any ink liquid is not jetted (white data process: ON) (i.e., an invalid nozzle address is determined) in a first line (head row A: XA1, head row B: XB1) from the tip portion of the medium 21. When the ink nozzle addresses (h27 to h54) are set in such a manner that the ink liquid is jetted (white data process: OFF) (i.e., a valid nozzle address is determined), the image forming range varying process is performed. It is to be noted that in FIG. 3B, the respective ink nozzles set in such a manner as to jet the ink liquid (white data process: OFF) are shown in black.

In more detail, FIG. 6 shows the setting table of the forming control section 2. In this setting table, the ink head driving units (10A1 to 10A3, 10B1 to 10B3) at the time of the image formation are controlled to form the image with respect to the medium 21 shown in FIG. 3B.

In FIG. 6, set data is shown with respect to a first line from the tip portion of the medium 21, and a part of an n-th line, one line before a rear end portion of the medium 21. It is to be noted that in a "joining process" in FIG. 6, joints at the time of the image formation are treated in such a manner as to be inconspicuous by jetting, for example, while changing an ink drop number or an ink amount with respect to each ink nozzle address in which the end portions of the ink nozzles in the main scanning direction have overlaps (two or more ink nozzles are arranged on a straight line in the sub-scanning direction) in the respective ink heads in the head rows A and B.

According to the constitution of the first embodiment, for example, when one straight line is formed into an image in the main scanning direction on the medium 21, the image of one straight line is formed by the ink jetted by the ink heads of the head rows A and B.

Therefore, as shown in FIG. 6, during the setting of the ink head nozzle address of each ink head, in "selection of head row", "nozzle jet timing setting", "ON/OFF of white data process", and "ON/OFF of joining process", data is updated every pitch feed (predetermined pulse number of the encoder) in the conveying direction (sub-scanning direction) of the medium 21. That is, the image forming range is varied, and the image is formed by the forming control by the forming control section 2.

It is to be noted that data items updated every pitch feed are (XA1 to XAn) and (XB1 to XBn) in the "nozzle jet timing setting".

Figure 3C:
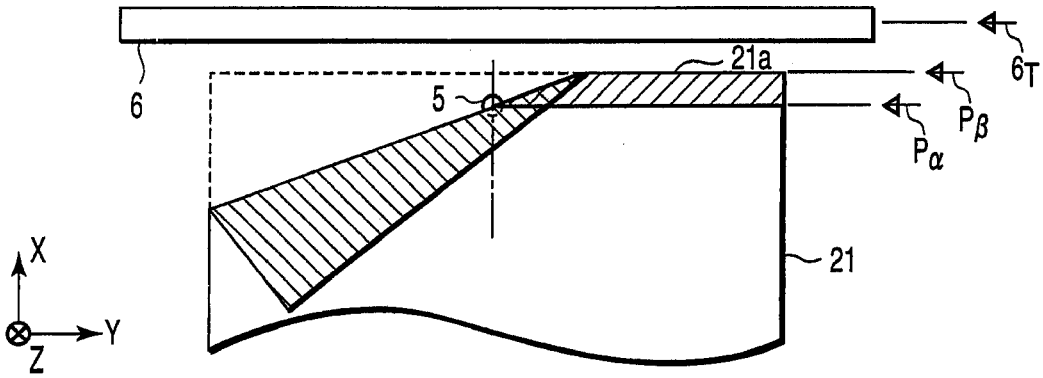

Moreover, FIG. 3C shows that a folded amount increases (left rising slant line portion) as compared with fold deformation of the medium 21 shown in FIGS. 3A, 3B. At a time (Pα) when the tip portion of the medium 21 is detected by the first detection unit 5, the other tip portion of the medium 21 has already moved to a position (Pβ) on a downstream side in a medium conveying direction.

In this case, even when the above-described image forming range varying process is executed, the image formation is substantially impossible with respect to a medium region (right rising slant line portion) moved on the downstream side in (Pα) to (Pβ), and a blank region is formed in which any image is not formed.

Therefore, in this case, an image forming process is discontinued without performing the image forming range varying process.

It is to be noted that it can be judged whether or not to discontinue the image forming process by the number of pulses in the conveying distance detection section 4 (encoder) from when the first detection unit 5 detects the tip portion of the medium 21 until the second detection unit 6 detects the portion.

That is, if the pulse number (pulse number between (Pβ) and (6T)) is reduced from when the first detection unit 5 detects the tip portion of the medium 21 until the second detection unit 6 detects the side end portion of the medium 21, it is determined that the other tip portion of the medium 21 has already moved to the position (Pβ) on the downstream side in the medium conveying direction. The number of pulses generated after when the first detection unit 5 detects the tip portion of the medium 21 until the second detection unit 6 detects the side end portion of the medium 21 is stored in the parameter memory 8, if the image-forming range can be varied (but not in the case shown in FIG. 3C).

In the first embodiment, a data format of one bit is used in selecting or setting each setting item in FIG. 6, but the present invention is not limited to this format. For example, two types of statuses may be set as sequential numbers "1", "2", distinguished, and judged.

As described above, according to the first embodiment, the shape of the conveyed medium is detected, and the image is formed in accordance with the shape of the medium in the image forming apparatus comprising a plurality of ink head rows, and accordingly the ink liquid jet in a range in which any medium does not exist can be prevented, and dirt around the conveying mechanism in the image forming apparatus can be prevented.

Next, a modification of the first embodiment will be described.

In the above-described first embodiment, two head rows are described as the example in which the ink heads of one nozzle row are arranged alternately in the conveying direction (sub-scanning direction) with the predetermined overlaps in the end portions of the ink heads in the main scanning direction. However, the present invention is not limited to this embodiment. The ink heads of two nozzle rows may be constituted in such a manner that the ink heads of one nozzle row are shifted by half pitch of nozzle formation in the main scanning direction, and are mutually laminated.

Figure 4:
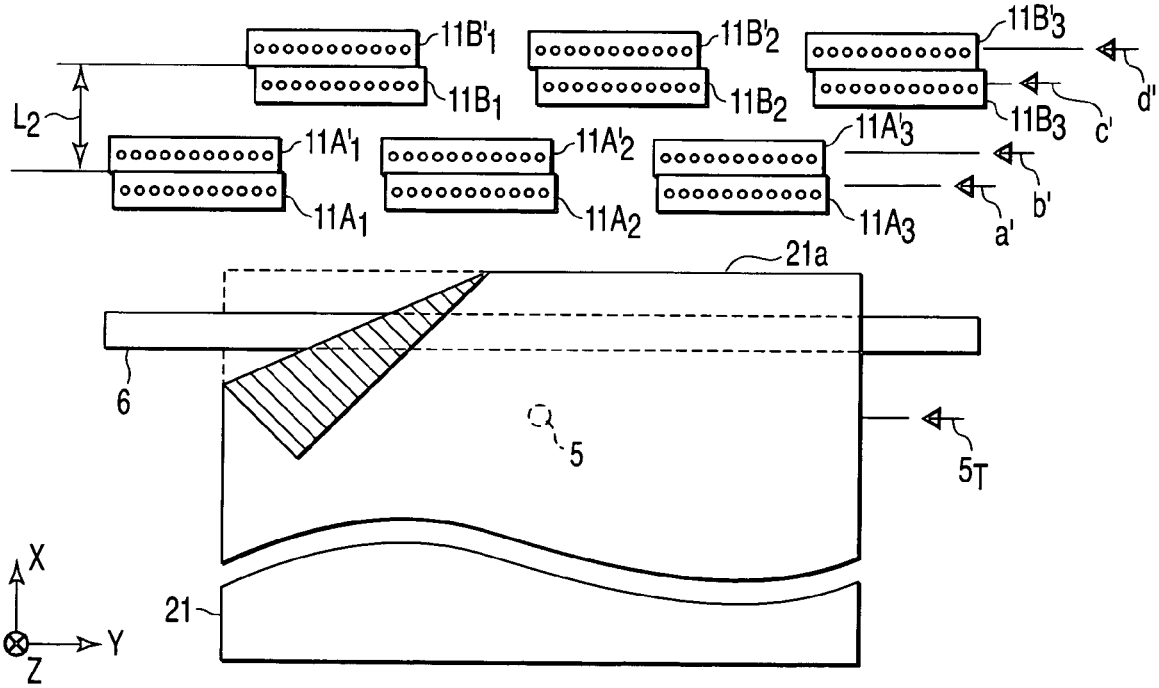
FIG. 4 is a diagram showing a relation between the arrangement positions of the respective ink heads and the medium in a modification of the first embodiment.

For example, as shown in FIG. 4, the ink heads 11A1 and 11A'1, 11A2 and 11A'2, 11A3 and 11A'3, 11B1 and 11B'1, 11B2 and 11B'2, or 11B3 and 11B'3 are mutually shifted by half pitch of the nozzle formation in the main scanning direction and mutually laminated. The ink heads including two nozzle rows are arranged alternately (predetermined distance L2) in the conveying direction (sub-scanning direction) with the predetermined overlap in the end portion of the ink head in the main scanning direction. Four head rows are constituted in this manner.

In FIG. 3A, the image forming range varying process is executed by the ink liquid reference jet timings (a: head row A, b: head row B) stored beforehand in the parameter memory 8 based on the machine difference for each image forming apparatus in order to control two ink head rows. On the other hand, in the present modification, as shown in FIG. 4, the image forming range varying process is executed by the ink liquid reference jet timings (a': head row A, b': head row A', c': head row B, d': head row B') stored beforehand in the parameter memory 8 based on the machine difference for each image forming apparatus in order to control four ink head rows. These ink liquid reference jet timings are determined by the signal (pulse number) output from the conveying distance detection section 4 (encoder), when the medium 21 is further conveyed on the downstream side after the output of the trigger signal ST during the edge detection of the tip portion of the medium 21 by the first detection unit 5.

Moreover, the control unit 1 which has received the trigger signal 5T drives the second detection unit 6 (image sensor) to bring the unit into a standby state, and lights the illumination unit 27 shown in FIG. 2. Furthermore, when the conveyed medium 21 passes under the second detection unit, the second detection unit 6 continuously detects the both transversal side ends of the medium 21 in synchronization with the signal of the conveying distance detection section 4 to thereby recognize the shape of the medium 21.

The image forming range varying process is possible by the above-described operation. In the present modification, an only difference of FIG. 7 which is a setting table inside the forming control section 2 from FIG. 6 will be described. Additionally, since a detailed procedure is similar to that of FIG. 3B, description thereof is omitted.

FIG. 7 shows four head rows (A, A', B, B'), and nozzle jet timings (XA1, X'A1, XB1, X'B1) of head rows in the image formation of the first line from the tip portion of the medium 21. In actual, image forming timings up to (XAn, X'An, XBn, X'Bn) which are not shown in FIG. 7 are set in the setting table inside the forming control section 2.

In FIG. 6 described above, the data format of one bit is used in the settings, or in selecting or setting each set item. On the other hand, in the present modification, the selecting or setting of four types of set items is practiced using a data format of two bits. Additionally, the present invention is not limited to this format. For example, judgment of four types of statuses may be set and distinguished with sequential numbers "1", "2", "13", "4".

As described above, according to the constitution of the present modification, in the same manner as in the first embodiment, the shape of the conveyed medium is detected, and the image is formed in accordance with the shape of the medium, accordingly the ink liquid jet in a range in which any medium does not exist can be prevented, and dirt around the conveying mechanism in the image forming apparatus can be prevented.

Figure 5:
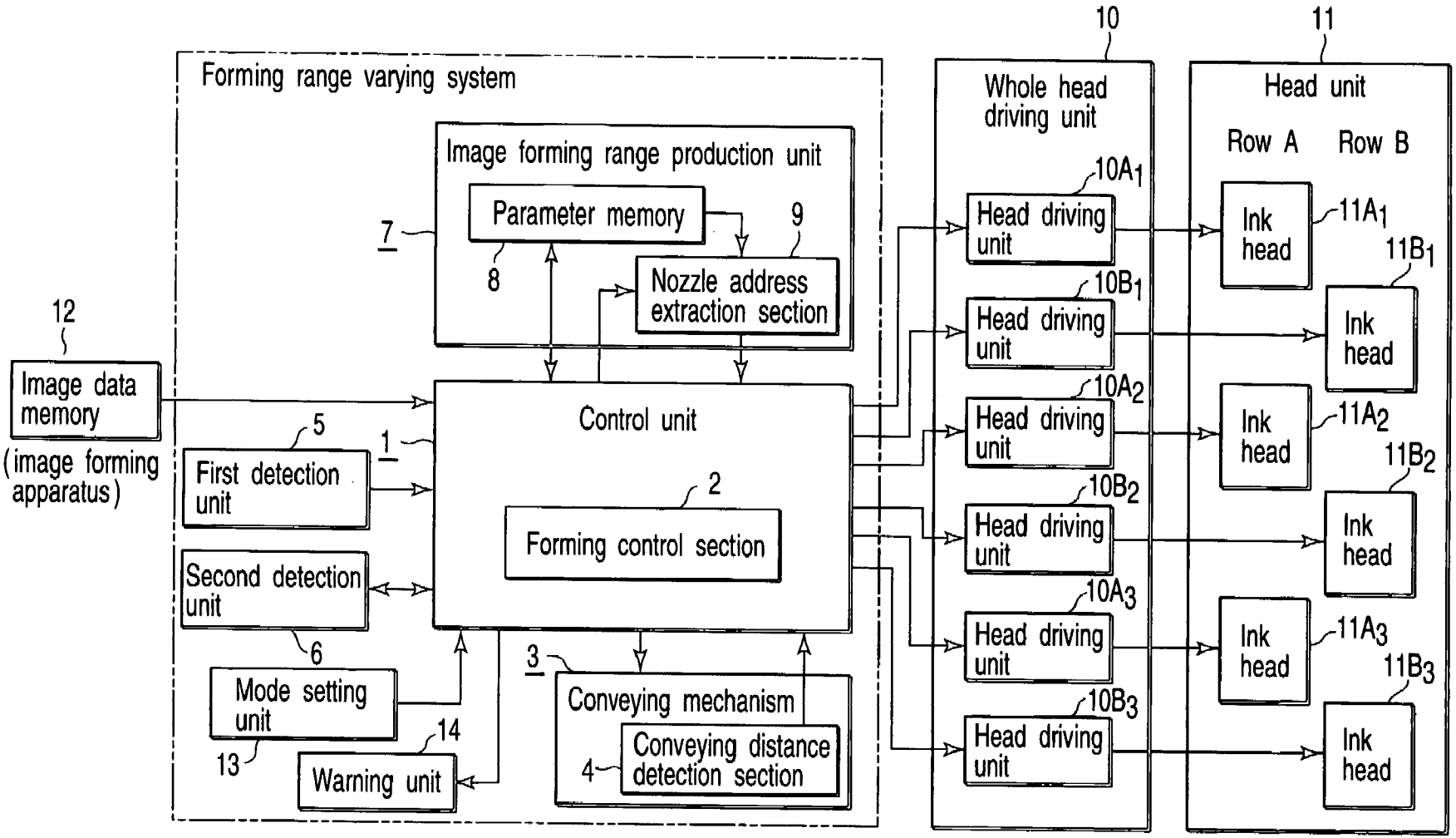
FIG. 5 is a diagram showing a conceptual constitution example of the image forming apparatus on which an image forming range varying system according to a second embodiment of the present invention is mounted.

Next, an image forming range varying system according to a second embodiment will be described with reference to FIG. 5.

In the second embodiment, a mode setting unit 13 and a warning unit 14 are newly added to the above-described first embodiment. The other constituting elements are similar to those of the first embodiment, and denoted with the same reference numerals, and detailed description thereof is omitted here.

The mode setting unit 13 according to the present embodiment sets various types of function modes beforehand in the image forming apparatus, and conditions are set beforehand in an image forming range varying process.

Moreover, the warning unit 14 displays or issues a warning based on a condition setting content by the mode setting unit 13.

Since the mode setting unit 13 and the warning unit 14 are added, the above-described image forming range varying process is performed on conditions set beforehand by the mode setting unit 13, for example, in the state shown in FIG. 3A of the first embodiment. Alternatively, when the image formation is once stopped, it is possible to select whether to instruct the display or the issuing of the warning by the warning unit 14.

Moreover, in the state shown in FIG. 3C of the first embodiment, the image formation is once discontinued, further such setting is possible that the warning unit 14 is instructed to display or issue the warning, and affinity to a operator of the image forming apparatus be enhanced.

As described above, according to the constitution of the second embodiment, in the same manner as in the first embodiment (including the modification), the shape of the conveyed medium is detected, and the image is formed in accordance with the shape of the medium in the image forming apparatus comprising a plurality of ink head rows. Accordingly the ink liquid jet in a range in which any medium does not exist can be prevented, and dirt around the conveying mechanism in the image forming apparatus can be prevented.

Furthermore, a detailed condition setting process by the operator of the image forming apparatus is possible during the execution of the image forming range varying process.

Moreover, in the present invention, a printer using the ink heads for jetting the ink liquid at the time of the image formation with respect to the medium has been described above as an example in the first embodiment, the modification, and the second embodiment. Needless to say, the present invention is not limited to this example, and the constituting elements may be modified and embodied in an execution stage without departing from the scope of the present invention. For example, the present invention is easily applicable to an image forming apparatus such as a copying machine. Various inventions can be formed by appropriate combination of a plurality of constituting elements described in the embodiments and the modification. For example, some constituting elements may be deleted from all the constituting elements described in the embodiments and the modification. Furthermore, the constituting elements over different embodiments may be appropriately combined.

According to the present invention, there can be provided an image forming range varying system of an image forming apparatus, and an image forming range varying method, which are capable of detecting the shape of the conveyed image forming medium and end portion positional shift, and forming an image to be formed in accordance with the shape of the end portion of the medium.

What is claimed is:

1. An image forming range varying system for an image forming apparatus which jets liquid ink to a conveyed image forming medium to form an image, and which includes an ink head unit comprising at least two ink head rows each including a plurality of ink heads extending in a direction substantially orthogonal to a conveyance direction of the image forming medium, wherein the ink heads of the at least two ink head rows are alternately arranged with a predetermined overlap between respective ink heads of the at least two ink head rows in the conveyance direction of the image forming medium, the image forming range varying system comprising:

a first detection unit which is disposed on a supply side of the image forming medium and which detects a tip portion of the image forming medium;

a conveying mechanism which conveys the image forming medium, and which outputs conveying information of the image forming medium;

a second detection unit which detects both transversal side ends of the image forming medium;

an image forming range production unit which produces/outputs information of an image forming range with respect to the image forming medium by determining a valid nozzle address and an invalid nozzle address for each ink head based on detection results output by the second detection unit and based on pre-stored image forming reference timing data corresponding to each ink head of the at least two ink head rows; and a control unit which varies/controls an image forming operation based on pre-stored appropriate image forming timing information and the image forming range information output by the image forming range production unit.

2. The image forming range varying system according to claim 1, wherein the ink head unit extends across a longer range than a length of the image forming medium in a direction crossing the conveying direction of the image forming medium.

3. The image forming range varying system according to claim 1, further comprising:

a tilt correction mechanism which corrects a tilt in at least the conveying direction of the image forming medium, on an upstream side of the first detection unit.

4. The image forming range varying system according to claim 3, wherein the tilt correction mechanism has a pair of rollers disposed substantially in parallel with the ink head.

5. The image forming range varying system according to claim 1, wherein the first detection unit detects a trigger signal for producing a detection timing in the second detection unit.

6. The image forming range varying system according to claim 1, wherein the first detection unit is disposed in a position through which a substantial center of the image forming medium passes in a direction crossing the conveying direction on an upstream side of the second detection unit, in the conveying direction of the image forming medium.

7. The image forming range varying system according to claim 1, wherein the first detection unit comprises one of an optical transmission/reflection type sensor and an electrostatic capacity type sensor.

8. The image forming range varying system according to claim 1, wherein the conveying mechanism conveys the image forming medium such that the transversal side ends detected by the second detection unit are in a substantially parallel direction with respect to the conveying direction of the image forming medium.

9. The image forming range varying system according to claim 1, wherein the second detection unit extends across a longer range than a length of the image forming medium in a direction crossing the conveying direction of the image forming medium.

10. The image forming range varying system according to claim 1, wherein the second detection unit comprises one of a line sensor and an image sensor.

11. The image forming range varying system according to claim 1, further comprising:

an illumination unit which is disposed in a vicinity of the second detection unit to provide illumination light such that the illuminating light is reflected from the image forming medium; and wherein the reflected light is input to one of a line sensor and an image sensor.

12. The image forming range varying system according to claim 11, wherein the illumination unit is lit by a trigger signal in the first detection unit.

13. The image forming range varying system according to claim 1, wherein the image forming range production unit uses an output signal of a conveying distance detection section disposed in the conveying mechanism in acquiring data in the second detection unit.

14. The image forming range varying system according to claim 13, wherein the conveying distance detection section has an encoder.

15. The image forming range varying system according to claim 13, wherein the image forming range production unit has a parameter memory, and stores at least two image forming reference timing data.

16. The image forming range varying system according to claim 1, wherein the image forming range production unit effects a joining process in mutual ink head end portions of at least two head rows arranged with the overlap.

17. The image forming range varying system according to claim 1, wherein the image forming range production unit has a parameter memory, and stores at least two image forming reference timing data.

18. The image forming range varying system according to claim 1, wherein the control unit has a forming control section which controls the ink head driving unit to drive the ink heads of the at least two ink head rows based on the image forming range information and image data of the image forming apparatus.

19. The image forming range varying system according to claim 1, further comprising: a mode setting unit.

20. The image forming range varying system according to claim 1, further comprising: a warning unit which notifies discontinuance of image formation based on a result of the image forming range production unit.

21. An image forming range varying system for an image forming apparatus which jets liquid ink to a conveyed image forming medium to form an image, and which includes an ink head unit comprising at least two ink head rows each including a plurality of ink heads extending in a direction substantially orthogonal to a conveyance direction of the image forming medium, wherein the ink heads of the at least two ink head rows are alternately arranged with a predetermined overlap between respective ink heads of the at least two ink head rows in the conveyance direction of the image forming medium, the image forming range varying system comprising:

a first detection unit which is disposed on a supply side of the image forming medium and which detects a tip portion of the image forming medium;

a conveying mechanism which conveys the image forming medium, and which outputs conveying information of the image forming medium;

a second detection unit which detects both transversal side ends of the image forming medium;

an image forming range production unit which produces/outputs information of an image forming range with respect to the image forming medium based on detection results output by the second detection unit; and a control unit which varies/controls an image forming operation based on pre-stored appropriate image forming timing information and the image forming range information output by the image forming range production unit, wherein the pre-stored appropriate image forming timing information comprises at least two image forming reference timing data set in accordance with an individual difference of an element of the image forming apparatus, and a machine difference of the image forming apparatus due to assembly error.

22. The image forming range varying system according to claim 21, wherein the image forming range production unit has a parameter memory, and stores at least two image forming reference timing data.

23. An image forming range varying method for an image forming apparatus which jets an ink liquid to form an image, the method comprising:

detecting a tip portion of a conveyed image forming medium on a supply side of the image forming medium;

detecting both transversal side ends of the conveyed image forming medium, based on a moving distance detection signal in a conveying mechanism using a detection signal of the tip portion of the conveyed image forming medium as a trigger;

producing information of an image forming range with respect to the image forming medium by determining a valid nozzle address and an invalid nozzle address of each ink head of an ink head unit which includes at least two ink head rows, based on position data of the conveyed image forming medium and pre-stored image forming reference timing data corresponding to each ink head of the at least two head rows;

setting image forming conditions to a control unit based on pre-stored appropriate image forming timing data of the image forming medium and the produced image forming range information; and driving each ink head of the at least two ink head rows to thereby form an image based on the image forming conditions set to the control unit.

24. The image forming range varying method according to claim 23, further comprising, before detecting the tip portion of the conveyed image forming medium, correcting a tilt of at least the image forming medium in a moving direction.

25. The image forming range varying method according to claim 23, further comprising, before detecting the tip portion of the conveyed image forming medium, setting a mode to discontinue image formation; and providing a warning when a necessity for varying the image forming range occurs as a result of detection of the transversal side ends of the image forming medium.

26. The image forming range varying method according to claim 23, further comprising, after detecting the tip portion of the conveyed image forming medium and before detecting the transversal side ends of the conveyed image forming medium:

judging whether an end portion of the conveyed image forming medium passes further on a downstream side from the tip portion when the tip portion of the conveyed image forming medium is detected;

discontinuing image formation, and issuing a warning to a notification unit.

* * * * *